United States Patent [19]

Ogawa

[11] 4,433,272

[45] Feb. 21, 1984

[54] HIGH-PRESSURE DISCHARGE LAMP

[75] Inventor: Soichiro Ogawa, Ohme, Japan

[73] Assignee: Hitachi, Ltd., Tokyo, Japan

[21] Appl. No.: 290,142

[22] Filed: Aug. 5, 1981

[30] Foreign Application Priority Data

Aug. 18, 1980 [JP] Japan ..... 55-112743

[51] Int. Cl.[3] ..... H05B 41/18

[52] U.S. Cl. ..... 315/290; 315/47; 315/73

[58] Field of Search ..... 315/47, 56, 73, 74, 315/289, 290, 362, DIG. 5

[56] References Cited

U.S. PATENT DOCUMENTS 4,135,114 1/1979 Narikiyo ..... 315/47

4,137,483 1/1979 Ochi et al. ..... 315/47 X

*Primary Examiner*—Eugene R. LaRoche

*Attorney, Agent, or Firm*—Antonelli, Terry & Wands

[57] ABSTRACT

A high-pressure discharge lamp has a starting circuit consisting of a bimetallic switch and a resistor, which is connected in parallel with the arc tube, and is turned on via a mercury lamp ballast. The current which flows into the starting circuit is limited by the current that flows into the arc tube and by the output of the ballast. Therefore, the extinguishing voltage phenomenon that hitherto had developed immediately after the lamp was turned on no longer takes place.

5 Claims, 5 Drawing Figures

HIGH-PRESSURE DISCHARGE LAMP

FIELD OF THE INVENTION

The present invention relates to a high-pressure discharge lamp, such as a metal halide lamp or a high-pressure sodium discharge lamp, in which mercury as well as luminous metal elements are enclosed in an arc tube. More specifically, the present invention relates to a high-pressure discharge lamp having a starting circuit accommodated in an outer bulb, so that it can be turned on with a conventional mercury lamp ballast.

BACKGROUND OF THE INVENTION

Metal halide lamps and high-pressure sodium lamps are high-pressure discharge lamps produced by enclosing a rare gas and a metal halide or sodium in an arc tube, and are superior to the conventional mercury lamps with respect to the color rendition and luminous efficacy. The high-pressure discharge lamps, however, require a considerably high starting voltage as compared to a mercury lamp. Therefore, it is not possible to turn on the high-pressure discharge lamps simply in the same manner as a mercury lamp.

To eliminate the above-mentioned problem, therefore, there has been proposed a high-pressure discharge lamp in which a starting circuit is accommodated in an outer bulb of the discharge lamp (Japanese Patent Laid-Open Nos. 67174/77 and 16475/78). The starting circuit employed in the discharge lamp of this type consists of a bimetallic switch and a filament that are connected in series. Further, the starting circuit is connected in parallel with the arc tube.

Such discharge lamps can be turned on by using a lighting circuit of a conventional mercury lamp, i.e., by using a lighting circuit which is connected to the commercial alternating power supply via a mercury lamp ballast. The starting circuit operates in such a way that, when a power-supply voltage is applied, an electric current flows into a starting circuit consisting of a mercury lamp ballast, a bimetallic switch and a filament, whereby the filament glows. When the bimetallic switch opens in response to the heat of the filament, a pulse of high voltage is generated by the self induction of the mercury lamp ballast and is superposed on the power-supply voltage. The pulse is then applied to the arc tube to initiate the discharge.

At present, there are five types of high-pressure sodium lamps (metal halide lamps) that can be turned on using conventional mercury lamp ballasts, i.e., there are lamps rated at 220 (250) watts, 270 (300) watts, 360 (400) watts, 660 (700) watts, and 940 (1000) watts. These lamps are turned on by using mercury lamp ballasts having output capacities of 250 watts, 300 watts, 400 watts, 700 watts and 1000 watts, respectively. From the standpoint of saving energy and the tendency today to use high-pressure discharge lamps indoors, however, it has been strongly urged to develop metal halide lamps and high-pressure sodium lamps which consume less energy, i.e., to develop metal halide lamps and high-pressure sodium lamps having small outputs.

To cope with such requirements, an arc tube which can be turned on using a mercury lamp ballast having a capacity of smaller than 200 watts was desired and produced, and the aforementioned starting circuit was accommodated in the bulb to produce a metal halide lamp as well as a high-pressure sodium lamp. These lamps were tested with regard to their starting characteristics, and certain problems were found. Namely, when the power-supply voltage is applied, the starting circuit works to turn on the lamp once. The lamp, however, develops an extinguishing voltage phenomenon immediately after it is turned on so that the properly turned-on state is not sustained. This is a serious problem which hinders the realization of metal halide lamps or high-pressure sodium lamps having small outputs.

SUMMARY OF THE INVENTION

The object of the present invention, therefore, is to provide a high-pressure discharge lamp having a small output, which precludes the extinguishing voltage phenomenon, and which accommodates a starting circuit that reliably sustains the turned-on state by using a mercury lamp ballast.

In order to accomplish the above-mentioned object according to the present invention, circuit is provided wherein the following requirement is satisfied, $$i_1/i_2 \leqq 0.69\times10^{-3}X+0.24$$

where $i_1$ represents a current (A) that flows into the starting circuit when the high-pressure discharge lamp is to be turned on, $i_2$ represents a current that flows into the arc tube immediately after the high-pressure discharge lamp is turned on, and X represents the output (W) of a mercury lamp ballast, where X is equal to or smaller then 200.

Owing to such a characteristic setup of the present invention, it is possible to provide a high-pressure discharge lamp which eliminates the extinguishing voltage phenomenon immediately after the lamp is turned on, and which reliably sustains the turned-on state. Consequently, the mercury lamp of a small output can be replaced by a metal halide lamp or a high-pressure sodium lamp having a small output, which has a high color rendition and a high luminous efficacy, presenting great advantage from the standpoint of saving energy.

DESCRIPTION OF THE PREFERRED EMBODIMENTS

Figure 1:
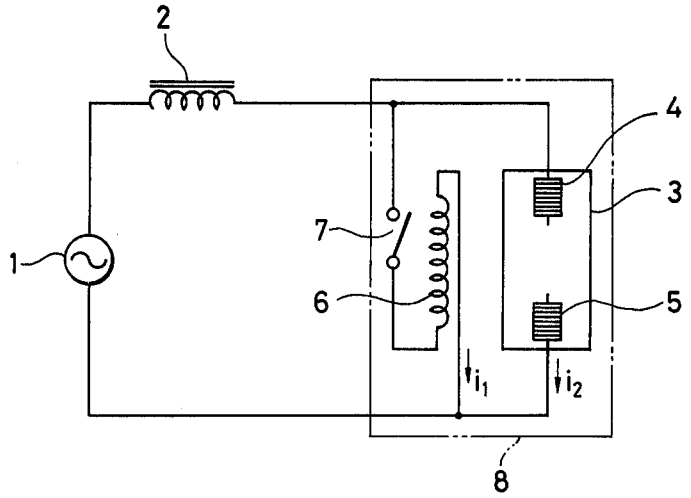
FIG. 1 is a diagram showing the fundamental setup of a high-pressure discharge lamp according to the present invention.

FIG. 1 shows a fundamental setup of a high-pressure discharge lamp according to the present invention, in which an arc tube 3 is connected in series with a commercial alternating power supply 1 via a mercury lamp ballast 2, thereby to form a lighting circuit of the discharge lamp tye. The arc tube 3 has a pair of electrodes 4, 5 which are air-tightly secured in the respective ends of the tube which contains mercury, rare gas and any desired luminous metal element. For example, the high-pressure sodium lamp may contain a suitable amount of sodium as the luminous element.

The arc tube 3 having electrodes 4, 5 at its respective ends is connected in parallel with a starting circuit which consists of a resistance 6, such as a tungsten filament, and a thermal switch, such as a bimetallic switch 7. The starting circuit consisting of the resistance 6 and the bimetallic switch 7 is accommodated in an outer bulb 8 together with the arc tube 3, forming the discharge lamp.

Before the discharge lamp is turned on, the bimetallic switch 7 accommodated in the outer bulb 8 maintains its contact point in a normally closed condition. The discharge lamp is turned on under this condition. Therefore, when the commercial alternating power supply 1 is turned on, an electric current $i_1$ flows into the starting circuit consisting of the bimetallic switch 7 and the resistance 6 via the mercury lamp ballast 2, and the bimetallic switch 7 is heated by the thermal energy radiated from the resistance 6. Therefore, the bimetallic switch 7 opens its contact point when heated to a predetermined temperature, and the electric current $i_1$ flowing into the starting circuit is interrupted. Consequently, a pulse of high voltage is induced in the mercury lamp ballast 2. Since the contact point of the bimetallic switch 7 is opened, the pulse of high voltage induced in the mercury lamp ballast 2 is applied across the electrodes 4, 5 on both sides of the arc tube 3. A discharge therefore takes place across the electrodes 4 and 5 of the arc tube 3, and the discharge lamp is turned on.

Experiments were conducted to find the cause of the extinguishing voltage phenomenon that develops when the discharge lamp is turned on using a mercury lamp ballast having a capacity of smaller than 200 watts. The cause was found to relate to the lamp circuit. Namely, as the output of the lamp becomes smaller, the lamp current $i_2$ becomes small immediately after the discharge lamp is turned on. With a high-pressure discharge lamp having a small lamp output, therefore, the thermal energy radiated from the arc tube 3 during the initial stage of the operation of the discharge lamp is not sufficient to keep open the contact point of the bimetallic switch 7. Consequently, the bimetallic switch 7 is closed, and a current (current I obtained by dividing the voltage of the lamp which is in operation by the resistance of the starting circuit) flows again into the starting circuit. At this moment, the extinguishing voltage phenomenon takes place in the discharge lamp. The cause is attributed to the fact that the lamp current $i_2$ which is nearly equal to a secondary short-circuit current of the mercury lamp ballast 2 flows into the arc tube 3 immediately after the discharge tube is turned on. However, as the output of the discharge lamp becomes smaller (in other words, as the output of the mercury lamp ballast becomes smaller), the lamp current $i_2$ becomes small. Therfore, when the bimetallic switch 7 is closed, and the current I flows again into the starting circuit, the lamp current $i_2$ is reduced by an amount that flows into the starting circuit. Consequently, the arc tube 3 can no longer maintain the discharge; i.e., the arc discharge extinguishes.

To prevent the extinguishing voltage phenomenon, therefore, a lamp current $i_2$ should flow which is at least as great as that necessary to maintain the discharge in the arc tube 3 even when the bimetallic switch 7 is closed again after the discharge lamp has been turned on and the electric current I flows into the starting circuit. In other words, the extinguishing voltage phenomenon can be prevented by limiting the current $i_1$ which flows into the starting circuit when the discharge lamp is being turned on.

Therefore, experiments were carried out with regard to the high-pressure sodium lamps (metal halide lamps) having output ratings of 36 (40) watts, 70 (80) watts, 85 (100) watts and 180 (200) watts, in order to find relations among the current $i_1$ which flows into the starting circuit when the discharge lamp is to be turned on, the current $i_2$ which flows into the arc tube 3 immediately after the lamp is turned on (unlike the lamp current which flows under steady-state condition, this current has a considerably large value), and the output X of the mercury lamp ballast. These lamps were turned on using mercury lamp ballasts having output ratings of 40 watts, 80 watts, 100 watts and 200 watts, respectively.

Figure 2:
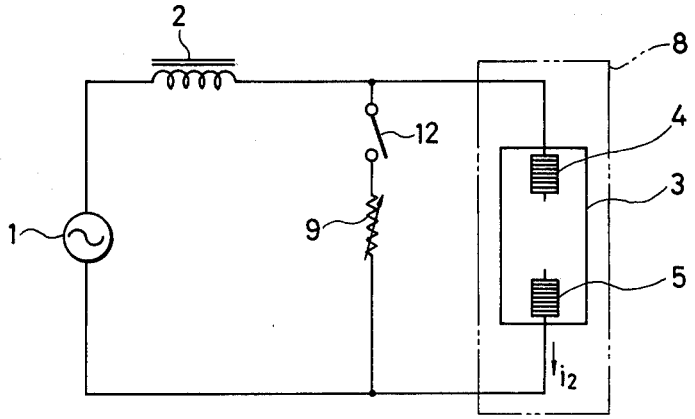
FIG. 2 is a diagram showing an experimental setup to illustrate the present invention.

FIG. 2 shows a fundamental setup of the experimental circuit. The experiment consists of permitting the discharge to take place across the electrodes 4 and 5 of the arc tube 3, and varying the resistance of a variable resistor 9 connected in parallel with the arc tube 3, in order to turn the switch 12 on. Immediately after the discharge lamp is turned on, the lamp current $i_2$ which is nearly equal to the secondary short-circuit current of the mercury lamp ballast flows into the arc tube 3. The electric current also flows into the variable resistor 9 connected in parallel with the arc tube 3. Here, a resistance is found that does not invite the extinguishing voltage phenomenon when the switch 12 is turned on. A value obtained by dividing the power-supply voltage (200 volts) by the thus found resistance is equal to the usable minimum current $i_1$ which flows into the starting circuit. Therefore, a ratio of the current $i_1$ to the secondary short-circuit current $i_2$ of the mercury lamp ballast 2 (i.e., lamp current immediately after the discharge lamp is turned on), was found. Therefore, the extinguishing voltage phenomenon can be completely prevented by setting the ratio of current $i_1$ flowing into the starting circuit to the lamp current $i_2$ immediately after the lamp is turned on, to be smaller than the above-mentioned ratio.

For example, when the high-pressure sodium lamp having an output of 85 watts is turned on using a 100-watt mercury lamp ballast, the lamp current $i_2$ immediately after the lamp is turned on is 1.6 amp. which is equal to the secondary short-circuit current of the 100-watt mercury lamp ballast. Immediately after the lamp was turned on, a resistor was connected in parallel with the lamp to determine whether the extinguishing voltage phenomenon developed. It was confirmed that the extinguishing voltage did not develop when the resistance was greater than 400 ohms. Therefore, when the discharge lamp is turned on, the current $i_1$ which flows into the starting circuit with the resistance being 400 ohms is 0.5 amp. Accordingly, the ratio of the current $i_1$ flowing into the starting circuit when the lamp is turned on to the secondary short-circuit current $i_2$ of the 100-watt mercury lamp ballast is 0.31, i.e., the ratio $i_1/i_2$ is 0.31. Namely, it is possible to prevent the occurrence of the extinguishing voltage phenomenon by so controlling the current that flows into the starting circuit that the current ratio $i_1/i_2$ is smaller than 0.31. Experiments were also carried out with regard to other lamps, and results were obtained, as shown in FIG. 3.

Figure 3:
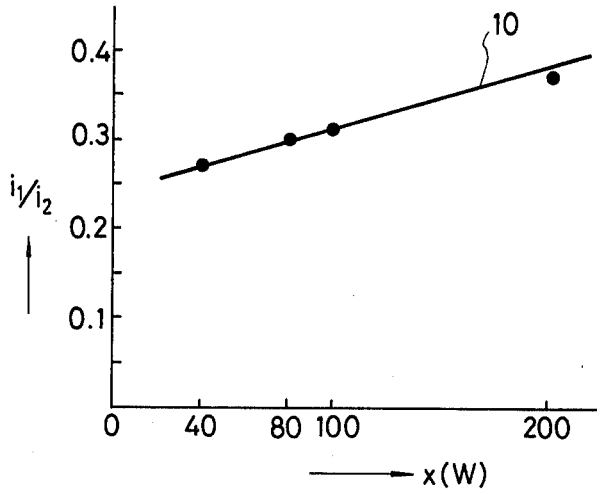
FIG. 3 is a graph prepared on the basis of the data obtained from the experimental setup of FIG. 2.

FIG. 3 shows the change of current ratio $i_1/i_2$ when the outut X is changed from 40 to 200 watts, in which the ordinate represents the current ratio $i_1/i_2$, and the ordinate represents the output X (watts) of the mercury lamp ballast. The change in current ratio is represented by a straight line 10. When the high-pressure sodium lamps of various lamp outputs are to be turned on, however, the mercury lamp ballasts having corresponding capacities will be used. The current ratio $i_1/i_2$ represented by the line 10 of FIG. 3 can be given by the following approximation as a function of output X of the mercury lamp stabilizer.

$$i_1/i_2=0.69\times10^{-3}X+0.24$$

To prevent the extinguishing voltage phenomenon that develops when the output x of the mercury lamp ballast is smaller than 200 watts, the starting circuit should be so designed that it works in a range which is smaller than the current ratio $i_1/i_2$ represented by the line 10. In other words, it is possible to produce high-pressure sodium lamps of the small-output type which do not develop the extinguishing voltage phenomenon by so designing the high-pressure sodium lamps that the equation $$i_1/i_2\leqq0.69\times10^{-3}X+0.24$$

is satisfied, but $X\leqq200$.

In practice, the current $i_1$ is controlled by adjusting the whole resistance of the starting circuit. For this purpose, the resistance of the filament which chiefly determines the resistance of the starting circuit is adjusted. Here, the output X of the mercury lamp ballast is limited to be smaller than 200 watts. This is because, in lamps (the high-pressure sodium lamps produced thus far have outputs of greater than 220 watts) employing ballasts with capacities greater than 200 watts, sufficiently large lamp current flows after it has been turned on, and the bimetallic switch sustains the open state owing to the thermal energy emitted by the arc tube. Further, even in the case where the bimetallic switch is closed, a very great lamp current flows immediately after the lamp is turned on as compared with the current which flows into the starting circuit. Accordingly, the extinguishing voltage phenomenon does not develop.

Figure 4:
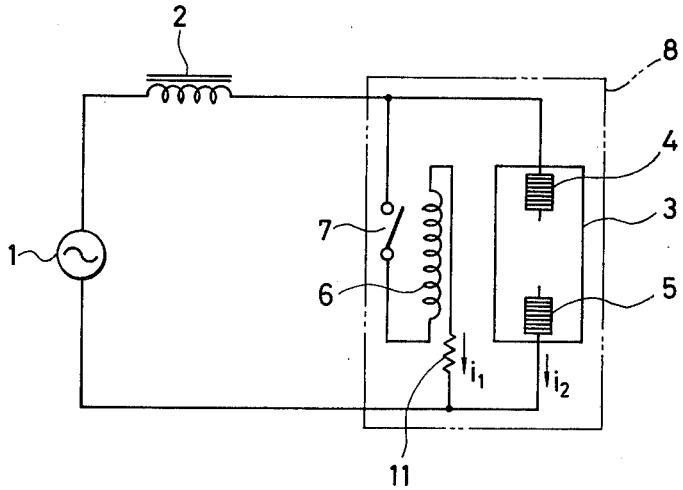
FIGS. 4 and 5 are diagrams of fundamental setups according to further embodiments of the present invention.

FIG. 4 illustrates a fundamental setup according to another embodiment of the present invention. The difference of this embodiment from that of FIG. 1 resides in the starting circuit. Namely, the starting circuit shown in FIG. 1 consists of the bimetallic switch 7 and the resistor 6, such as tungsten filament. On the other hand, the starting circuit according to this embodiment consists of the bimetallic switch 7, the resistor 6 and a solid resistor 11. The solid resistor 11 is added in order to facilitate the control of current $i_1$ that flows into the starting circuit. Therefore, even when the filament 6 having a fixed resistance is employed, the current $i_1$ which flows into the starting circuit can be adjusted by replacing the fixed resistor 11. That is, the starting circuit of this embodiment makes it possible to very simply adjust the current $i_1$.

Figure 5:
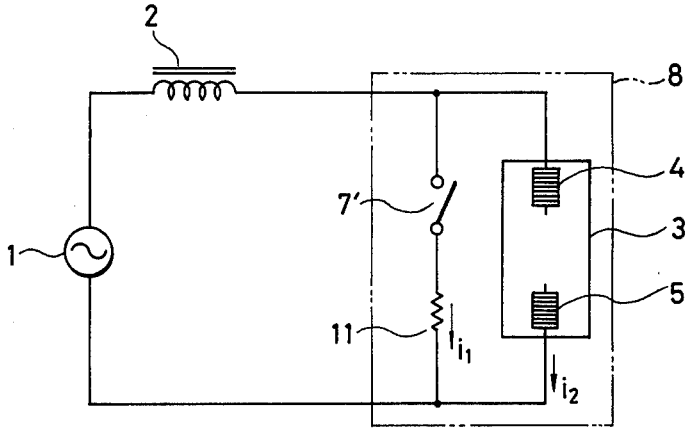

FIG. 5 illustrates a further embodiment according to the present invention. The difference of this embodiment from that of FIG. 4 resides in the starting circuit and, particularly, in the bimetallic switch. Namely, the bimetallic switch 7 shown in FIG. 4 must receive the thermal energy emitted from the filament 6 so that the contact point is maintained open. The bimetallic switch 7' shown in FIG. 5, on the other hand, is of the self-heating type that need not be heated by the filament. The current $i_1$ flowing through the starting circuit is controlled by adjusting the resistance of the fixed resistor 11 in the same manner as the above-mentioned embodiment.

In the aforementioned three embodiments, the practical lower limit of current $i_1$ flowing into the starting circuit is 0.1 amp. This is because the magnitude of the pulse induced in the mercury lamp ballast when the lamp is to be turned on is determined as a function of the current $i_1$ which flows into the starting circuit. Therefore, if the current $i_1$ is smaller than 0.1 amp., it is not possible to obtain a pulse having a voltage high enough to turn on the lamp.

Further, a conducting wire is usually used as a starting aid to facilitate the ignition of the high-pressure sodium lamp. Therefore, although not diagrammed, the conducting wire is used in the above-mentioned embodiments.

Furthermore, although the above embodiments have dealt with the high-pressure sodium lamp as a high-pressure discharge lamp, the present invention can of course be adapted to metal halide lamps having small outputs.

As mentioned above, the present invention makes it possible to reliably turn on the high-pressure discharge lamps, such as high-pressure sodium lamps and metal halide lamps having an output of smaller than 200 watt accommodating a starting circuit, by using a conventional mercury lamp ballast. Consequently, high-pressure discharge lamps having color rendition and luminous efficacy superior to those of the mercury lamp can be turned on in the same manner as the mercury lamp, presenting great advantage from the standpoint of saving energy.

While I have shown and described several embodiments in accordance with the present invention, it is understood that the same is not limited thereto but is susceptible of numerous changes and modifications as known to one of ordinary skill in the art, and I therefore do not wish to be limited to the details shown and described herein but intend to cover all such changes and modifications obvious to those skilled in the art.

What is claimed is:

1. In a high-pressure discharge lamp in which a starting circuit, consisting of a thermal switch and a resistor connected in series, is connected in parallel with an arc tube, and said arc tube is connected to a power supply via a mercury lamp ballast connected in series with said arc tube, the improvement comprising means for controlling the starting current $i_1$ of the starting circuit and the current $i_2$ of the arc tube according to the following relationship:

$$i_1/i_2\leqq0.69\times10^{-3}X+0.24$$

wherein $X\leqq200$, where $i_1$ denotes the current in amps that flows into said starting circuit when the lamp is to be turned on, $i_2$ denotes the current in amps that flows into said arc tube after the lamp is turned on, and X denotes the output power in watts of said ballast.

2. A high-pressure discharge lamp according to claim 1, wherein said starting circuit consists of a bimetallic switch and a filament that are connected in series.

3. A high-pressure discharge lamp according to claim 1, wherein said starting circuit consists of a bimetallic switch, a filament, and a fixed resistor that are connected in series.

4. A high-pressure discharge lamp according to claim 1, wherein said starting circuit consists of a self-heating-type bimetallic switch and a fixed resistor that are connected in series.

5. A high-pressure discharge lamp according to claim 1, wherein said arc tube contains mercury and rare gas, as well as other luminous metal elements and metal halides.

* * * * *